United States Patent [19]

Murakami

[11] Patent Number: 4,919,197

[45] Date of Patent: Apr. 24, 1990

[54] ATMOSPHERE CONTROL APPARATUS FOR THEATERS

[76] Inventor: Kanji Murakami, 7-1-12-102, Minamiaoyama, Minato-ku, Tokyo, Japan

[21] Appl. No.: 293,095

[22] Filed: Jan. 3, 1989

Related U.S. Application Data

[62] Division of Ser. No. 79,698, Jul. 30, 1987, Pat. No. 4,838,344.

[30] Foreign Application Priority Data

Sep. 2, 1986 [JP] Japan ..... 61-206114

[51] Int. Cl.[5] ..... F25B 29/00; G03B 21/32

[52] U.S. Cl. ..... 165/48.1; 352/85; 62/78; 98/30; 272/9

[58] Field of Search ..... 165/48.1; 352/85; 62/78; 98/30; 272/9

[56] References Cited

U.S. PATENT DOCUMENTS

| | | | |
|---|---|---|---|
| 1,583,060 | 5/1926 | Lewis . | |
| 1,749,187 | 3/1930 | Leavell | 352/85 |
| 1,977,315 | 10/1934 | Lewis | 165/48.1 |
| 2,689,467 | 9/1954 | Verber | 62/140 |
| 3,291,904 | 12/1966 | Ratliff, Jr. | 352/85 |
| 3,532,156 | 10/1970 | Berryhill | 165/3 |
| 3,795,438 | 3/1974 | Westerholz et al. | 352/85 |
| 4,385,814 | 5/1983 | Elliott | 352/85 |
| 4,629,604 | 12/1986 | Spector | 352/85 |

*Primary Examiner*—John Ford

[57] ABSTRACT

The atmosphere control apparatus of the present invention employs first and second chambers located for example, adjacent the ceiling and adjacent the floor of the audience seating section of the movie theater, respectively. Both chambers have a large storage capacity. Cool air and warm air, supplied from an air conditioner, are stored in the first and second chambers, respectively. In order to create an atmosphere similar to that in, for example, a movie scene, the cool air in the first chamber and the warm air in the second chamber are selectively blown outward, in the direction of the audience seating section, in accordance with a control signal.

3 Claims, 6 Drawing Sheets

ATMOSPHERE CONTROL APPARATUS FOR THEATERS

This is a division of application Ser. No. 07/079698, filed Jul. 30, 1987.

BACKGROUND OF THE INVENTION

This invention relates to an atmosphere control apparatus for enabling patrons in a theater, for example, a movie theater, to vividly experience the same atmosphere as that in a movie scene or on stage.

Attempts so far to recreate the atmosphere in, for example, a movie scene, have largely been confined to briefly varying the ambient temperature in the theater. Providing even this simple atmospheric effect, however, has necessitated the installing of bulky equipment, with resultant high operating costs.

SUMMARY OF THE INVENTION

It is accordingly the object of this invention to provide an atmosphere control apparatus which can create an atmosphere similar to that in a movie scene or on stage, so that the audience can experience the created atmosphere, but which is relatively simple in its arrangement and inexpensive to operate.

An atmosphere control apparatus according to this invention comprises:

an air conditioner for air-conditioning the audience seating section in a movie theater or other theater;

a storage space for enabling cool and warm air, produced by the operating of the air conditioner, to be conducted to first and second chambers via respective air paths separated from air paths which are to the audience seating section;

first and second pistons for independently compressing the air within the first and second chambers;

a first electromagnetic valve unit, for passing either the air exhausted from the first chamber or the air from the second chamber, or the air exhausted from both first and second chambers;

a second electromagnetic valve unit, for receiving the air selected by the first electromagnetic valve unit and for selectively supplying the air to a plurality of exhaust devices which are provided at a plurality of locations within the audience seating section;

a feedback path for selectively recovering the air from the audience seating section and returning it to the first and second chambers; and a system controller which, in order for the audience to experience an atmosphere similar to that in a movie scene or on stage, controls at least the first and second pistons and first and second electromagnetic valve units in synchronism with data corresponding to the atmosphere in the aforementioned scene.

DETAILED DESCRIPTION OF THE PREFERRED EMBODIMENTS

In general, people feel variations in the ambient temperature most at a first stage through their sensors and, thereafter, their sensation becomes dull. By using this human attribute, the present apparatus can enable people to effectively experience the ambient temperature, even on a small impact by an air-conditioner on them, without controlling, for example, the whole ambient temperature.

If normal body temperature (for example, 25° C.), neither hot or cold, is defined here as being 0°, then a person can physically experience the ambient temperature ranging from tropical to polar climate, even if the ambient temperature which is released as such is ±5° C. For the temperature exceeding this ambient temperature thus released, the human being feels uncomfortable in spite of this fact.

The present apparatus has been conceived with this fact in mind. Since it is not necessary to move a larger mass of air, the ambient temperature can be accurately controlled so as to correspond to any change of scene in a movie then being shown.

The feature of the present apparatus basically lies in using a storage container which can store the exhaust heat of an existing air conditioner. The air, selectively drawn from the storage container, is blown into the audience seating section of a house or theater, to provide an atmosphere similar to that in the theatrical or movie scene.

Figure 1:
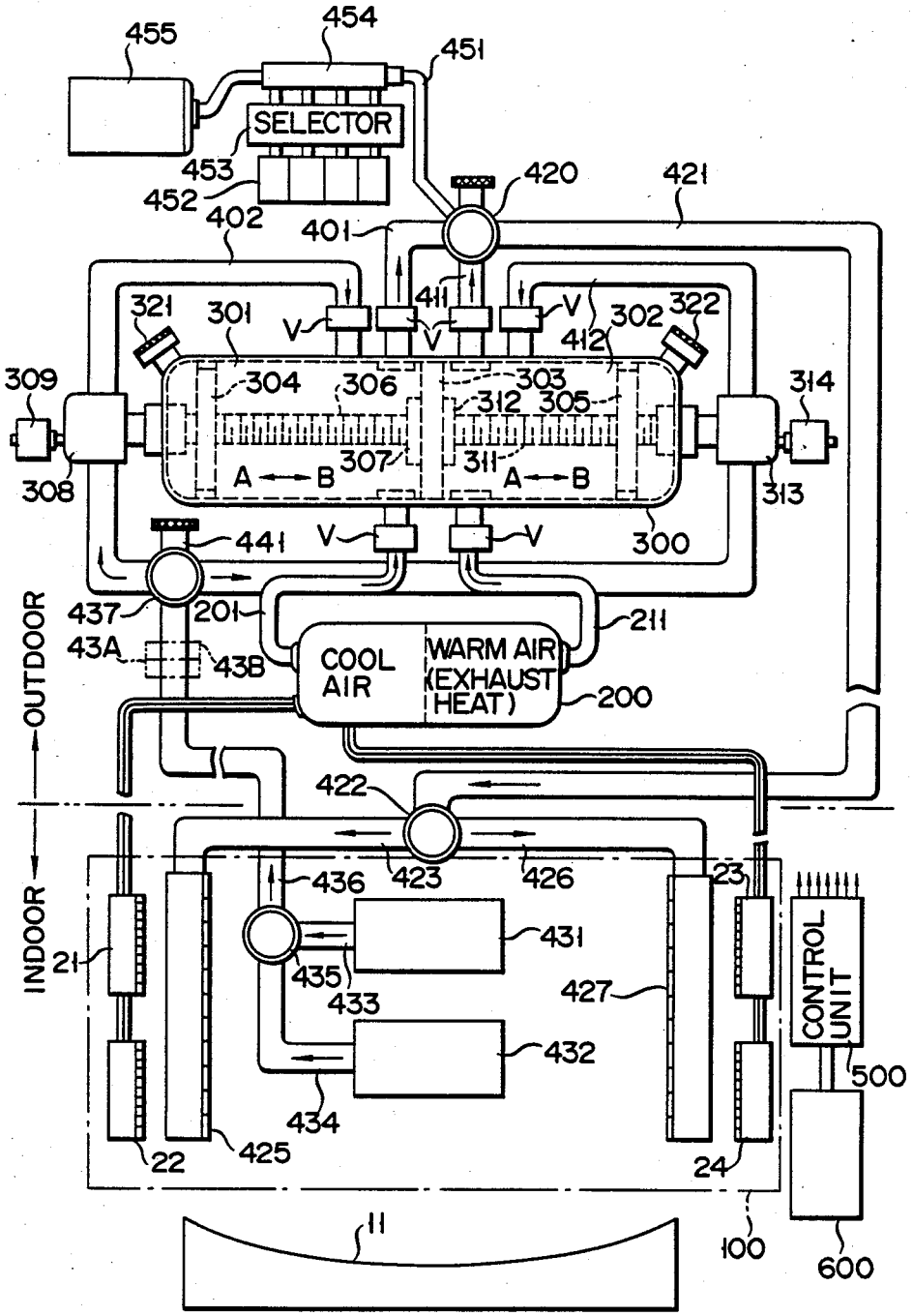
FIG. 1 is an explanatory view showing an atmosphere control apparatus according to one embodiment of this invention.

FIG. 1 shows an atmosphere control apparatus according to one embodiment of this invention. Reference numeral 100 shows the audience seating section of a theater. Exhaust and suction devices 21, 22, 23, 24 are disposed within the audience seating section, to exhaust the cold or the warm air from air conditioner 200.

According to this invention, storage unit 300 for storing the cold or warm air supplied from air conditioner 200, is placed outdoors. Note that the unit in the upper half of FIG. 1 is and that in the lower half are shown in different scales.

Storage container 300, if a cooling mode is performed within, for example, the house, has first chamber 301 for storing the cooling air and second chamber 302 for storing the exhaust heat (warm air) as obtained for cooling. Chamber 301 is separated by partition wall 303 from chamber 302.

Cooling air is supplied from air conditioner 200 through pipe 201 to first chamber 301 and warming air is supplied from air conditioner 200 through pipe 211 to second chamber 302.

Pistons 304 and 305 are contained within first and second chambers 301 and 302, respectively. Upon the rotation shaft 306, piston 304 can be moved in a direction as indicated by an arrow A or B in FIG. 1. Rotation shaft 306 has its one end rotatably supported on bearing 307 attached to partition wall 303 and the other end of rotation shaft 306 extends out of first chamber 301 and is connected through clutch mechanism 308 to first motor 309 for drive. Upon the rotation of rotation shaft 311, piston 305 can be moved in a direction as indicated by an arrow A or B. Rotation shaft 311 has its one end rotatably supported on bearing 312 attached to partition wall 303. The other end of rotation shaft extends out of first chamber 302 and is connected through clutch mechanism 313 to first motor 314.

When rotation shaft 304 is rotated by motor 309, then piston 304 is moved in the direction as indicated by the arrow B in FIG. 1, causing the air within chamber 301 to be exhausted into exhaust pipe 401. On the other hand, when piston 304 is moved in the direction as indicated by the arrow A in FIG. 1, the air within pipe 402 is sucked into chamber 301. Upon the rotation of rotation shaft 311 by means of motor 314, piston 305 is moved in the direction of the arrow A in FIG. 1, causing the air within chamber 302 to be exhausted into exhaust pipe 411. When, on the other hand, piston 311 is moved in the direction of the arrow B, the air within pipe 412 is sucked into chamber 302. A check valve V is provided on each of pipes 201, 211, 401, 402, 411 and 412.

Now suppose that cool air is introduced into audience seat section 100. Motor 309 is driven upon receipt of an instruction from control unit 500 to cause piston 304 to be moved in the direction of the arrow B in FIG. 1. The air stored in first chamber 302 is sent into pipe 401, valve device 420 and pipe 421. The air in pipe 421 is sent into selected pipe 423 or 426 by valve device 422. The air from pipe 423 is introduced through sending section 425 toward audience seat section 100. On the other hand, the air in pipe 426 is introduced through sending section 427 toward audience seat section 100. Valve devices 420 and 422, each, have an electromagnetic valve and, upon receipt of a control signal from control unit 500, control their input/output paths. If, for example, the scene of "the cool wind's blowing from right to left" is displayed on screen 11, than respective valve devices 420 and 422 and other associated devices are so controlled that the cool air within first chamber 301 is sent through sending section 425.

Where the cool air thus sent toward audience seat section 100 is to be recovered, piston 304 is so controlled that is it moved in the direction as indicated by the arrow A in FIG. 1. The cool air is recovered into first chamber 301 through suction inlets 431 and 432 on the ceiling and on the floor of audience seat section 100 and then through pipes 433 and 434, valve device 435, pipe 436, valve device 437 and pipe 402. The cool air from air conditioner 200 is always replenished into first chamber 301 so as to prevent a rise in the internal temperature.

The cool air has been explained in connection with introducing the cool air toward audience seat section 100 but, in the case of introducing warm air, motor 314 is controlled, moving piston 305 in the direction as indicated by the arrow A. As a result, the warm air is sent into valve device 422 through valve device 420 and pipe 421. Valve device 422 sends the warm air into pipe 423 or 426 in accordance with the scene on screen 11. Now suppose that, for example, a "fire" scene is displayed on the left side portion of the screen. In this case, the warm air is sent through pipe 426 into sending section 427. In order to recover the warm atmosphere, piston 305 is so controlled that it is moved into the direction as indicated by the arrow B in FIG. 1. The warm air is recovered into second chamber 302 through suction inlets 431 and 432 provided on the ceiling and on the floor of audience seat section 100 and then through pipes 433 and 434, valve device 435, pipe 436, valve 437 and pipe 412.

Release sections 321 and 322 are provided on storage container 300 to allow pistons 304 and 305 to be readily controlled.

The apparatus of this invention can effectively utilize the outer atmosphere outside the theater house.

Valve device 437 has suction inlet 441 for taking in the other atmosphere. Now let it be assumed that the indoor atmosphere has been cooled in the summer season. In this case it is necessary that the cool atmosphere from air conditioner 200 prevails in first chamber 301. If the outdoor atmosphere is very high, it can be taken into second chamber 302 through suction inlet 441. It is possible to utilize the exhaust heat of air conditioner 200.

The aforementioned controlled atmosphere corresponds to the case where the atmosphere around the audience seat section 100 is cooled in view of the hot outdoor temperature at which time the cooled atmosphere is at the same temperature level as that within air conditioner 200, that is, at the same temperature level as that around the audience seat section. Where the created atmosphere is imparted to the viewers or spectators, the cooled air within first chamber 301 is supplied to audience seat section 100 so that the spectator can experience an adequately cool atmosphere. Let it be assumed that the indoor atmosphere is warmed in spite of the winter season. It is necessary that the warm air within air conditioner 200 be stored in second chamber 302. If the outdoor temperature is sufficiently low, it is possible to take it into first chamber 301 through suction inlet 441.

According to this invention, another new atmosphere can be created around audience seat section 100 with aroma developed as the "ambience effect" in the created atmosphere. That is, valve device 420 can select aroma wafting pipe 451. An aroma filling device includes a plurality of cylinders 452 each with different aroma contained therein, valve device 453 adapted to select either one of cylinders 452 to couple it liquid inlet to jetting section 454 and air blower 454 for flowing compressed air into jetting section 454. Upon jetting the compressed air from air blower 455 into jetting section 454, liquid aroma is atomized there and sent to pipe 421 so that the aroma wafts around the audience seat section.

Cylinders 452 are initially prepared which contain various kinds of liquid aroma as selected in accordance with the scenes of, for example, a movie. As the aroma use is made of, for example, perfume which comes from flowers or trees or fruit juices. For example, the drinkers can inspire the aroma of alcohol at the bars or snack stands and exhaust gas may preferably be used, as an ordor, at the scene of a car race or powder smoke may be used in the gun-battle scene. In order to create that atmosphere of aroma or odor, there are cases where the viewers or spectators can experience the warm or cool atmosphere with the odor or aroma mixed therewith and the cases where the audience can be placed under the pleasant odor or aroma alone with the involved temperature constant. In order for the atmosphere of the aroma to be created the air within first chamber 301 and that within second chamber 302 are controlled to permit then to be simultaneously sent while mixing order or aroma constituents therewith. An alternative way is to send only the odor or aroma constituents through the connection of the aroma to valve device 420.

According to this invention it is proved advantageous to use ordinary air conditioner 200 in combination with storage container 300 of a capacity greater than the air conditioner. Since the atmosphere thus created has only to be imparted to the viewers or spectators at restricted time intervals, the warm and cool air can initially be stored into storage container 300 with a longer period of time. Furthermore, since the apparatus of this invention can effectively utilize the viewer's subtle sensitivity to such an impact as set forth above in place of varying the temperature of the whole indoor atmosphere around the viewers, they can effectively experience the created ambient atmosphere simply through a minor variation of it with a less amount of gas. In order to more effectively attain such effects, various modifications may be made in the shape and configuration of sending sections 425 and 427. Although, in the embodiment, sending sections 425 and 427 have been explained as being located one on the right side and one on the left side of the audience seat section, they may be arranged one behind the other. Sending sections 425 and 427 need only to be located substantially at a height level at which the viewers receive the flown air at their sitting position.

Although, in the aforementioned embodiment, the warm or cool air has been explained as being blown toward the audience seat section through the use of pistons 304 and 305, this invention is not restricted thereto. The ambient temperature may be controlled through the opening/closing operation of the electromagnetic valve in which case the cool or warm air may be stored in a compressor, such as a balloon. Furthermore, the cool or warm air can be delivered into the chamber with the use of a fan for an high-speed operation. A fan-type blower can effectively be applied to a small-scale hall or ordinary household room. The apparatus of this invention can be used in combination with air conditioner 200 either for the control of an ambient atmosphere or to quickly cool or warm the room or the hall.

In the apparatus of this invention the air around the audience seat section 100 is recovered into storage container 300. Deodorant-equipped device 43A is provided on a feedback path to remove the spent order or cleaning device 43B may be provided to clean and sterilize the spent air, thus assuring a better sanitary environment.

Figure 2:
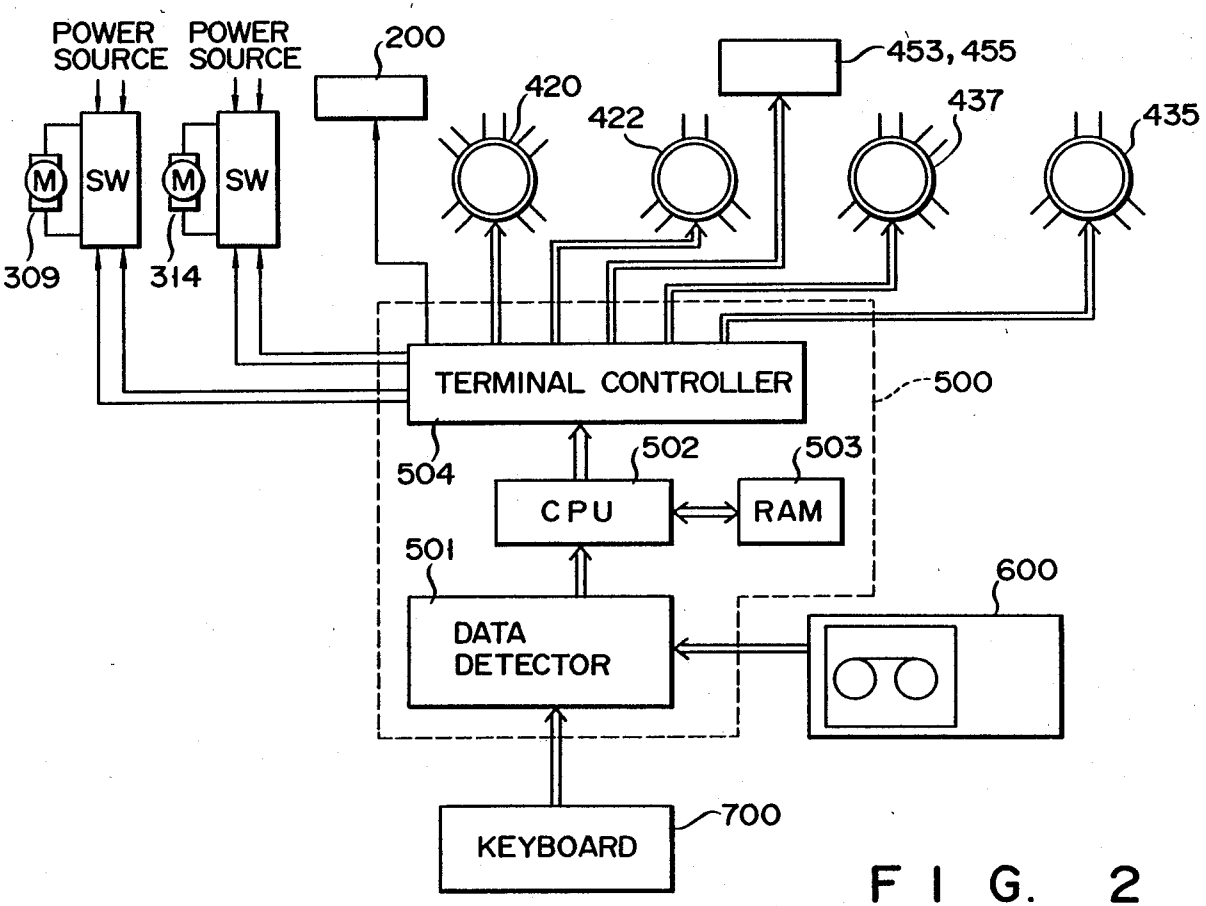
FIG. 2 is an explanatory view showing one form of an electric control system in the embodiment shown in FIG. 1.

FIG. 2 shows a relation among control unit 500, reproduction apparatus 600 and associated units to be controlled, such as the motor and valve device. The atmosphere control data is stored, in a multiplexing fashion, on sound signals on the sound track of, for example, a video tape or a film. The atmosphere control data reproduced on reproduction apparatus 600 is detected by data detector 501 in control unit 500. The atmosphere control data can be entered by manually operating keyboard 700.

The atmosphere control data detected by data detector 501 is read out by cpu 502, the output of which is stored in memory 503. The data is read out of memory 503 at a proper time corresponding to, for example, the scene of the movie. Terminal controller 504, upon receipt of the atmosphere control data, controls associated units 420, 422, 437, 435 and 453. The terminal controller 502 can also control the power of air conditioner 200 and, in this case, it can be used in combination with the whole system to create the ambientatmospheric effect.

Various recording media, such as a movie film, magnetic tape or disc, can be used as the recording media for reproducing unit. The atmosphere control data of a whole program is recorded in proper place, for example, on the record start portion of the recording medium. The atmosphere control data is initially stored in memory 503 and read out at a proper time at the start of the program to achieve the atmosphere control.

Figure 3:
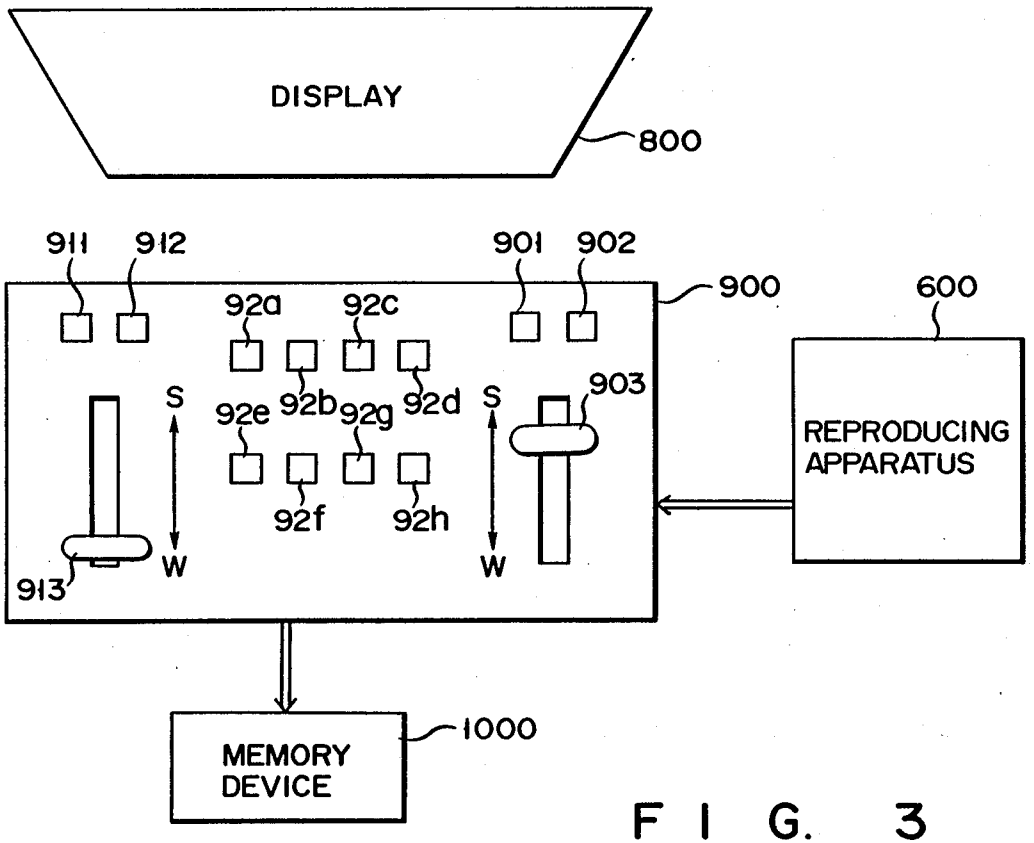
FIG. 3 is an explanatory view showing a data preparation device for performing atmosphere control.

FIG. 3 shows a data preparation unit for preparing the atmosphere control data. For example, reproduction unit 600 is used to reproduce the data on the videotape. The videotape program is displayed on display 800 in the "play" mode. Here data preparation unit 900 is operated in accordance with the scene of the program and thus the atmosphere control data can be prepared in accordance with that scene.

Let it be assumed that the scene of the "cool wind's being blown from the right side of the screen" is displayed on the screen. Data preparation unit 900 includes cool air generation key 901 placed on the right side and operation level 903 for preparing air intensity control data. When operation lever 903 is moved in the direction of an arrow S in FIG. 3 with cool air generation key 901 moved to an ON side, then the intensity of the air can be increased. The intensity of the air can be decreased upon the shift of operation lever 903 toward the arrow W side. From the above it is appreciated that the operation lever can be operated in accordance with the contents of the scenes. With the change of the scene the cool air becomes unnecessary and thus cool air generation key 901 is shifted toward the OFF side. With warm air generation key 902 on the right side of data preparation unit 900 shifted to the ON side it is possible to prepare data for the generation of the warm air.

Cool air generation key 911, warm air generation key 912 and operation lever 903 are provided on the left side of data preparation unit 900. Upon the operations of these members it is possible to prepare control data on the scene representing that the air is blown from the left side of the screen. The operation is performed in accordance with the contents of the scene.

Operation keys **92*a* to 92*h* are provided at the middle of data preparation unit 900 to prepare order control data. The operation keys 92*a* to 92R**, each, correspond to a key of different order.

The data of data preparation unit 900 is temporarily stored in memory device 1000. Respective data formats are arranged as shown, for example, in FIG. 4. That is, a start bit R1 is data bit showing the start of control data, basic control data R2 is data showing the kinds of control, such as air or odor, and start time data R3 is data showing a time interval from the start of the program to the start of the atmosphere control based on basic control data R2 in which case, for example, the count data of the counter can be utilized. Continuation time data R4 is data showing a time period for containing this type of atmosphere control starting from this control operation. Additional data R5 and R13 are data for applying extra atmosphere control while the atmosphere control is made based on basic control data R2. Where, for example, aroma is being intermittently wafted toward the viewers on the audience seat section in the situation where the cool air is being flowed form the right side of the movie screen, cool air generation key 901 is placed in the ON state by the basic control key 901 and operation keys **92*a* to 92*h* are selectively operated to provide the corresponding aroma. Where, for example, the scene representing that the cool air is being blown from the right side with varying intensity is displayed on the screen, then operation lever 903 is operated to yield variation control data. The variation control data is prepared through the convention of the output analog signal of operation lever 903 to a digital signal over a predetermined time period. End data R13** is data showing the end of an atmosphere control data train and is generated upon the shift to the OFF side of the operation key corresponding to the basic control data.

The aforementioned data R1 to R13 are temporarily stored in a register with the data R1 to R13 as one block and transferred to memory device 1000 upon the shift toward the OFF side of the operation key corresponding to the basic control data.

When a new scene emerges on the screen of display 800, data preparation unit 900 is operated in the same fashion as set out above so that a corresponding atmosphere can be developed.

Figure 5:
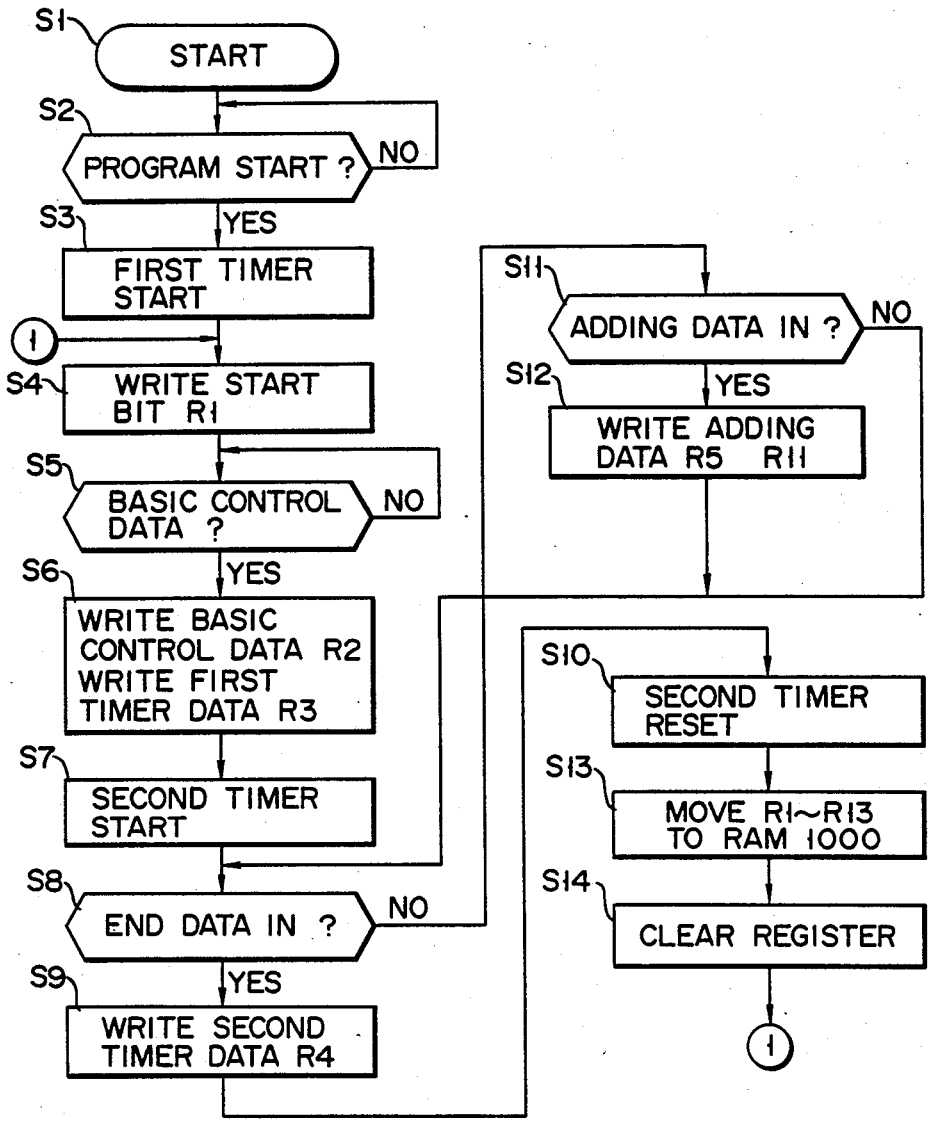
FIG. 5 is a flow chart for explaining the operation of the data preparation unit.

FIG. 5 is a flowchart showing the operation of data preparation unit 900. At step S1, the system is started and, at step S2, check is made as to whether or not the program of, for example, the reproduction apparatus 600 is stated. The program start signal is manually input from, for example, keyboard 700 or is input with the use of the output of the play operation switch on reproduction unit 600.

Figure 4:
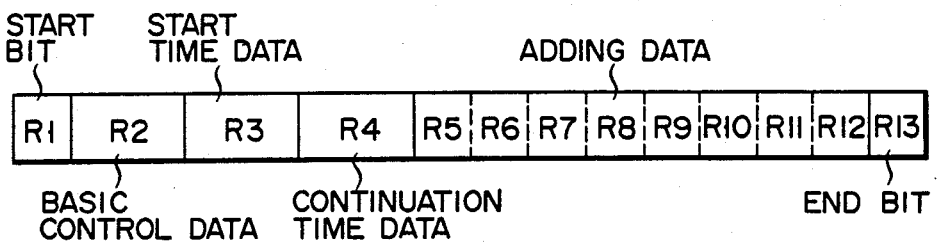
FIG. 4 is an explanatory view showing one form of the atmosphere control data as employed in this invention.

At the start of the program, the first timer is started at step S3 so as to obtain the time-base data of the program. The start bit R1 is written into the register of the type as shown in FIG. 4. Then detection is made as to whether the basic control data R is present or not (step S5). If the data R is present, the basic control data R is written in the corresponding register and the first timer data R3 is also written into the register (step S6). Thus the types of atmosphere control, as well as the time data from the start of the program to the start of the control data, are stored in the register.

Then the second timer is started (step S7). The data of the second timer is utilized for the determination of the continuation time of the control data. At step S8 detection is made as to where or not the end data is entered. The end data is generated when the operation key corresponding to the basic control data is released. When the end data is entered at step S8, the process goes to step 9 at which the second timer data R4 is written into the register. At step S10 the second timer is reset and the process goes to step S13 at which the data R1 to R13 which have been stored in the register are transferred to memory device 1000 for storage. The process goes to step S14 at which the register is cleared. Thus the process goes to steps S1 to S4. When the end data is not detected at step 8, the process goes to step 11 at which detection is made as to whether or not additional data R5 (or R6 to R12) is input over a predetermined time period. If any additional data is not detected, the routine process goes to step S8. When, on the other hand, the addition data is detected at step 11, it is written into the register in the order of R5, R6, . . . , R12 (step S12).

In this way, the control packet of a data format as shown in FIG. 4 is prepared in accordance with the respective control scene and stored, as plurality of data for one program, in memory device 1000.

When the tape or film on reproduction unit 600 is wound back after the completion of the program, data is written into the predetermined section of the winding-start portion of the tape or film.

Figure 6:
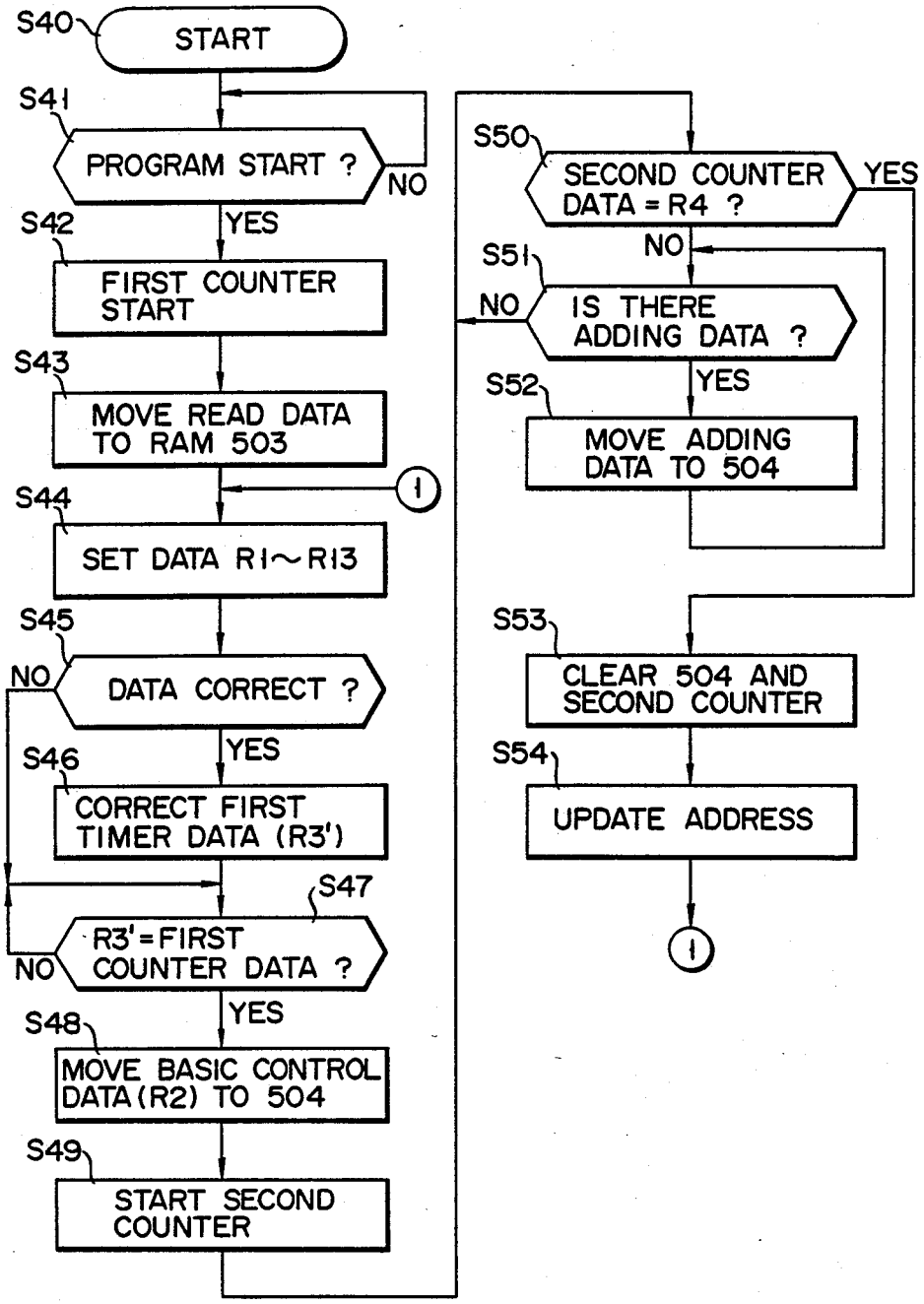
FIG. 6 is a flowchart for explaining the operation of the apparatus of this invention.

FIG. 6 shows an operation procedure when the atmosphere control data is supplied to control unit 500 (FIG. 2) subsequent to reproducing the tape or film with atmosphere control data written thereon on the reproduction unit.

With the system placed in the operative state at step S40 (FIG. 6) it is judged whether or not the program of reproduction unit 600 is started (step S41). Upon the start of the program the first counter initiates a time count (step S42). Then the atmosphere control data is read out of the tape or film and transferred to RAM503 (step S43). The data R1 to R13 of the first control packet are transferred to the register of the same type as shown in FIG. 4.

Since the first counter counts the program run time, the system can know the timing of a supply of the base control data R2 to terminal controller 504 through comparison between the contents of the first counter and the start time data R3 for the control data. As evident for the flowchart (FIG. 5), however, since the atmosphere control data is prepared through the viewing of the movie scene, the actual effect is produced in a time-delayed fashion relative to the viewers on the audience seat section. Where the atmosphere control data is to be utilized in actual practice the first timer data R3 should be corrected, by eliminating such a time delay, so that the atmosphere control data is supplied to terminal controller 504 earlier than when it has been prepared. Due to the spacing around the audience seat section a desired effect or effects can be produced in a varying time after the atmosphere control data has been supplied to terminal control 504. For this reason, the corresponding correction data is input from keyboard 700 to correct the first-timer data.

At step S45 the aforementioned correction data is detected and the first-timer data R3 is corrected based on the correction data (step S46). In this case it is to be noted that the correction is made through, the substraction of the correction data from, for example, the first-timer data R3.

The first-timer data thus corrected is judged for its coincidence with the first-counter data (step S47). When a coincidence thus occurs between the first-timer data and the first-counter data, the base control data R2 is supplied from the register to terminal controller 504, thus starting the control of the motor and valve device shown in FIG. 2. Subsequently the second counter starts a time count operation (step S49). In this connection it is to be noted that this time count means measuring the continuation time of the atmosphere control on the basis of the base control data.

At step S50, comparison is made between the second-counter data and the continuation time data, i.e., the second-timer data R4 which has been prepared on the data preparation unit. When a coincidence occurs between the second-counter data and the second-timer data R4, the process goes to step S53 where the supply of the data to terminal controller 504 is shut off and the second counter is cleared. At step S54, the read-out address of RAM503 is updated in preparation for the next control packet.

At step S50, when no coincidence occurs between the second-counter and the second-timer data R4, judgement is made for the presence or absence of any additional data (step S51). When the additional data is judged as being present, the data R5 to R12 are sequentially supplied to terminal controller 504 at a predetermined time interval.

Figure 7A:
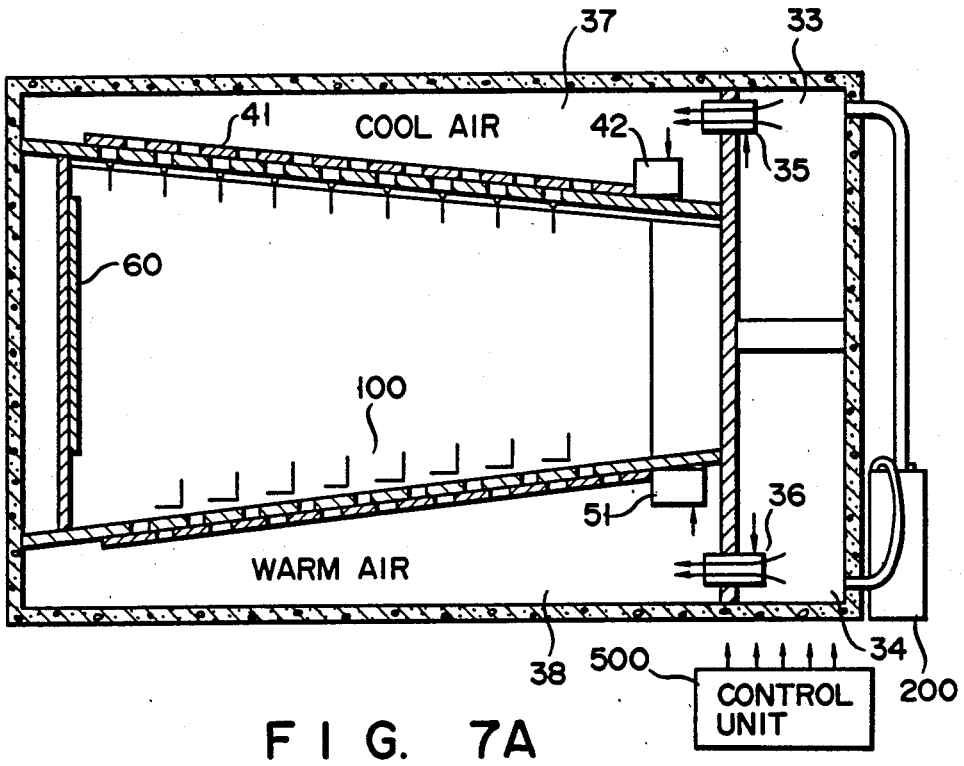
FIGS. 7A and 7B are views showing an atmosphere control apparatus according to another embodiment of this invention.

FIG. 7 shows another embodiment of this invention. In the embodiment of FIG. 1 the storage container is used separate from the house or building, while, in the embodiment shown in FIG. 7, spacing 37 just below the roof of the housing or building and spacing 38 just below the floor of the housing or building are utilized for the storage container.

The cool air of air conditioner 200 is sent into first container 33 for storage and the warm air of the air conditioner into second container 34 for storage. The cool air of first container 33 is sent into spacing 37 by means of blower 35 and the warm air of second container 34 into spacing 38 by means of blower 36. The cool air of spacing 37 is discharged from the ceiling holes toward audience seat section 100 by driving shutter mechanism 41 on the ceiling of the housing as required. Shutter mechanism 41 is driven by motor 42 which in turn is controlled by controller unit 500. The warm air of spacing 38 just below the floor of the house is sent through the holes of the floor by driving shutter mechanism 51 on the floor as required. The shutter mechanism is driven by motor 52 which in turn is controlled by controller unit 500.

Figure 7B:
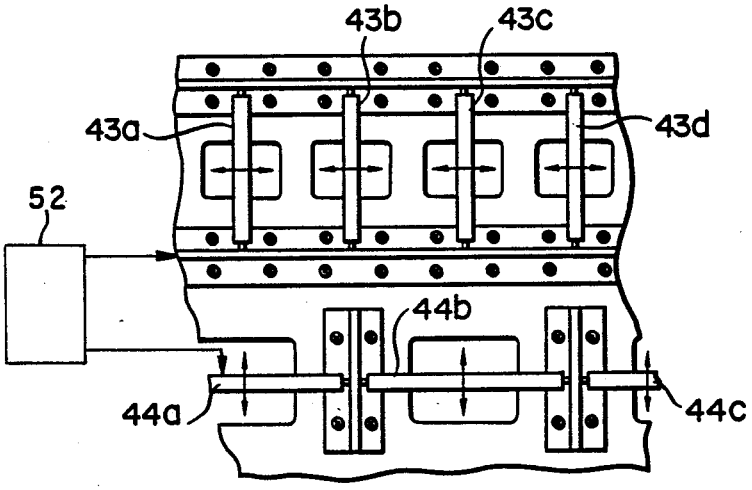

When, for example, the scene of "crew's riding on the motorboat" emerges on the movie screen, then the cool air is blown from the front section toward the audience seat section, noting that flaps are provided on the ceiling to control the direction of the air as shown in FIG. 7*b*. Flaps 43*a*, 43*b*, 43, . . . are used for controlling the air in the front-and-back direction while flaps 44*a*, 44*b*, 44*c* . . . are used for controlling the left-and-right direction. These flaps are driven by controlling the flap control motor 52 by means of the controller unit. Upon the rotation of the flap control motor, 52, the associated wire is drawn to allow the flaps to be tilted.

What is claimed is:

1. An air-conditioner system for air-conditioning a movie theater or other theater, comprising:

storage means for storing temperature conditioned air produced by the operation of an air-conditioner;

blower means for sending the temperature conditioned air from the storage means into an empty space above the ceiling of the audience seating section in a movie theater or other theater;

shutter mechanism means for controlling the flow of the temperature conditioned air discharged toward the audience seating section through holes provided through the ceiling;

a shuttle control motor for driving said shutter mechanism means;

flap means for controlling the blowing direction of the temperature conditioned air, said flaps means being provided below the ceiling and driven by a flap control motor; and system control means which, in order for the audience to experience the same atmosphere as that in a movie theater scene or other theater scene, controls shutter control and flap control motors in sychronism with data corresponding to the atmosphere in said scene.

2. The air conditioner as claimed in claim 1, wherein said storage means comprises a chamber adjacent the ceiling of the audience seating section in a movie theater or other theater.

3. The air conditioner as claimed in claim 2, wherein said storage means further comprises a chamber adjacent the floor of the audience seating section, the floor having holes for discharging temperature conditioned air toward the audience seating section, and further shutter mechanism means comprising means for controlling opening and closing of said holes.

* * * * *